US007373691B2

(12) United States Patent
Yamamoto et al.

(10) Patent No.: US 7,373,691 B2
(45) Date of Patent: May 20, 2008

(54) ERASER DISPENSER

(75) Inventors: Tadashi Yamamoto, Kawagoe (JP); Yoshio Noguchi, Kawagoe (JP)

(73) Assignee: Kotobuki & Co., Ltd., Kyoto-fu (JP)

( * ) Notice: Subject to any disclaimer, the term of this patent is extended or adjusted under 35 U.S.C. 154(b) by 674 days.

(21) Appl. No.: 10/915,426

(22) Filed: Aug. 11, 2004

(65) Prior Publication Data

US 2005/0166362 A1 Aug. 4, 2005

(30) Foreign Application Priority Data

Feb. 2, 2004 (JP) ..... 2004-025139

(51) Int. Cl.
*B43L 19/00* (2006.01)

(52) U.S. Cl. ..... 15/433; 15/434

(58) Field of Classification Search ..... 15/429–434, 15/209.1, 210.1, 231
See application file for complete search history.

(56) References Cited

U.S. PATENT DOCUMENTS

| | | | | |
|---|---|---|---|---|
| 2,115,806 A | | 5/1938 | Frederick | |
| 2,223,921 A | * | 12/1940 | Rudiger | 15/434 |
| 3,049,095 A | | 8/1962 | Murray | |
| 4,998,839 A | * | 3/1991 | Bashir | 401/208 |
| 6,203,226 B1 | | 3/2001 | Suzuki et al. | |

FOREIGN PATENT DOCUMENTS

| | | | |
|---|---|---|---|
| JP | 5-1426 | | 1/1993 |
| JP | 7-56233 | | 12/1995 |
| JP | 10-109498 | * | 4/1998 |
| JP | 10-250289 | * | 9/1998 |

* cited by examiner

*Primary Examiner*—Mark Spisich
(74) *Attorney, Agent, or Firm*—Rothwell, Figg, Ernst & Manbeck

(57) ABSTRACT

An eraser dispenser is provided which can store in a dispenser body an eraser longer than the overall length of the dispenser body. The eraser dispenser enables the eraser to be used without replacement with a new one for a long period of time. The eraser dispenser includes: a dispenser body which is enclosed by an outer circumferential wall having a distal opening and has a storing chamber capable of storing therein an eraser that is longer than the overall length of the dispenser body; and a cover which covers the dispenser body. The eraser dispenser further includes; an external operation member which partially projects from the outer circumferential wall and is operated from the outside of the dispenser body; a driving roller which is operated by the external operating member; a receiving member which is disposed opposite to the driving roller with the eraser held therebetween; and a stopper which prevents a rotary button as the external operation member from undergoing reverse turn.

7 Claims, 17 Drawing Sheets

ERASER DISPENSER

BACKGROUND OF THE INVENTION

1. Field of the Invention

The present invention relates to an eraser dispenser capable of appropriately advancing an eraser that is longer than the overall length of its dispenser body by use of an externally operating member.

2. Description of the Prior Art

As described in, for example, Japanese Utility Model Publication No. 5-1426, an eraser dispenser of this type has been configured such that a stick-shaped eraser is received in a tubular container and is advanced by knock operation for use. Since the stick-shaped eraser that is shorter than the overall length of the container is stored in the container, the eraser has to be reduced in length in order to make the container compact in size. Consequently, the eraser stored in the container is consumed for a short period of time. Thus, there is a frequent need to replace a worn eraser with a new one, causing cumbersome handling. Another patent document is Japanese Utility Model Publication No. 7-56233.

SUMMARY OF THE INVENTION

It is an object of the present invention to provide an eraser dispenser that can accommodates in its dispenser body an eraser, which is worn away for a short period of time in terms of its nature and circumstances, and which is longer than the overall length of the dispenser body so as to make longer intervals for replacement of the eraser.

It is another object of the present invention to provide an eraser dispenser whose dispenser body can be shaped freely in terms of configuration, thereby providing uniqueness for its design.

It is yet another object of the present invention to provide an eraser dispenser having excellent operability such that the eraser that has been extended is prevented from retracting into the dispenser body due to a pressing force exerted on the paper or the like through the eraser during its use.

It is still another object of the present invention to provide an eraser dispenser whose eraser can be shaped more freely in section as compared with the stick-shaped eraser used in a conventional chuck-holding type dispenser, so that an eraser deformed in section can be used by allowing the section of a holding roller, chuck or the like to conform therewith.

According to an aspect of the present invention, there is provided an eraser dispenser including: a dispenser body formed with a storing chamber capable of storing therein an eraser that is longer than an overall length of the dispenser body; an external operation member which is provided in the dispenser body and is operated externally; and eraser-advancing means for extending the eraser from a distal opening of the dispenser body.

The present invention provides an effect of storing a relatively long eraser in the dispenser body, so that the stored eraser can be used for a long period of time without replacing with a new one.

The present invention provides an effect of storing a long eraser in various states in terms of its nature, which causes the dispenser body to be shaped freely, providing uniqueness for its design.

The prevent invention provides an effect of offering excellent operability by preventing the eraser that has been extended from retracting into the dispenser body due to a pressing force exerted on the paper surface or the like through the eraser during the use.

The present invention provides an effect of shaping the cross-section of an eraser to be stored freely compared with that of the stick-shaped eraser used in a conventional chuck-holding type dispenser, so that an eraser deformed in section can be used by allowing the section of a holding roller, chuck or the like to conform therewith.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

The present invention provides an eraser dispenser including a dispenser body and a cover put on the dispenser body. The dispenser body stores therein an eraser that is longer than the overall length of the dispenser body. The dispenser body is formed at its front end with an opening adapted to extend the eraser out. A guide means to assist in advancing the eraser is provided near the opening. A driving means for advancing the eraser through the guide means is provided in the dispenser body. An operation means for drivingly operating the driving means from the outside is provided in the dispenser body. An anti-reverse turn means having a stopper which locks the operation means is provided.

Embodiment 1

Figure 1:
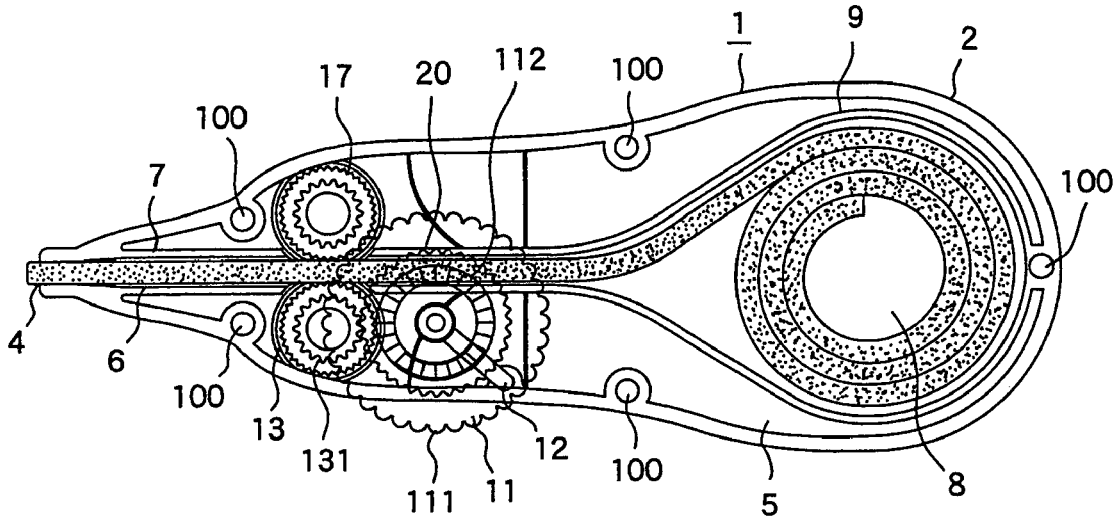
FIG. 1 is a front view of an eraser dispenser according to a first embodiment of the invention, with its cover removed.
Figure 2:
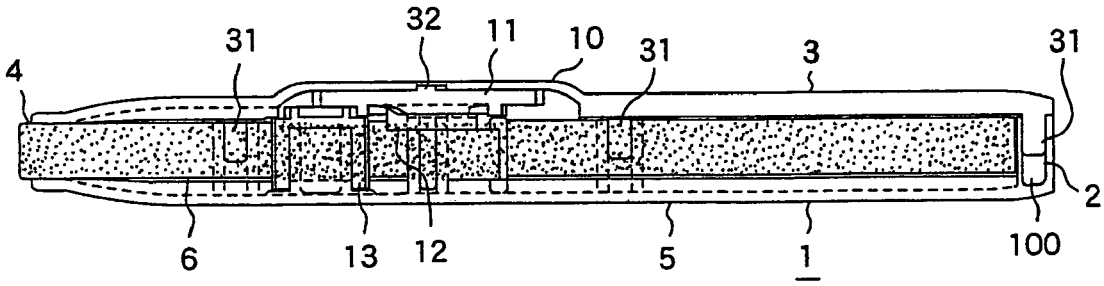
FIG. 2 is a bottom view of the eraser dispenser with the cover put thereon.

FIGS. 1 to 19 are views for illustrating an eraser dispenser according to a first embodiment of the present invention. Referring to FIGS. 1 and 2, the eraser dispenser includes a dispenser body 1 and a cover 3 put on the dispenser body 1. The dispenser body 1 has a base 5 and an outer circumferential wall 2 extending from the base upward and surrounding the same. The dispenser body 1 is flat in a substantial gourd-shape. The outer circumferential wall 2 is formed in positions with mounting recesses 100 for mounting the cover 3 thereto. On the other hand, the cover 3 is formed with projections 31 at positions corresponding to the mounting recesses 100 so that it can be fitted to the dispenser body 1. In addition, the cover 3 is formed with an oval bearing hole 32 adapted to receive an end of a fitting shaft 113 of a rotary button 11 to be described later. The oval bearing hole 32 is adapted to support a shaft 115 of the rotary button 11 for turning and displacement.

The dispenser body 1 has a tapered portion, which is formed at its front end with a distal opening 4. An eraser to be described later is extended through this distal opening 4. A pair of parallel guide walls 7 is provided adjacent to the distal opening 4. The guide walls 7 define an eraser passageway 6 for directing the eraser to be advanced to the distal opening 4. The rear portions of the guide walls 7 are formed in an expanded shape, defining a storing chamber 8 for storing the eraser in a spiral fashion. In other word, the storing chamber 8 is defined by storing-walls 9 connected to the guide walls 7.

Figure 14:
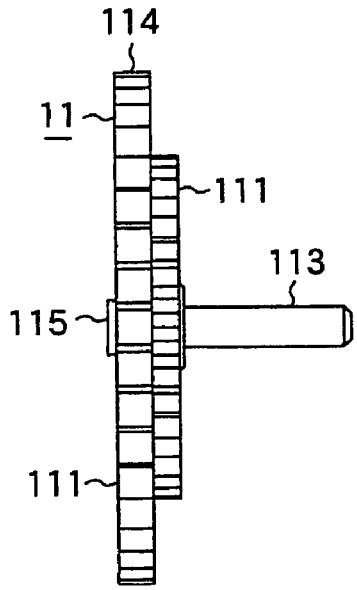
FIG. 14 is a plan view of a rotary button shown FIG. 1.
Figure 15:
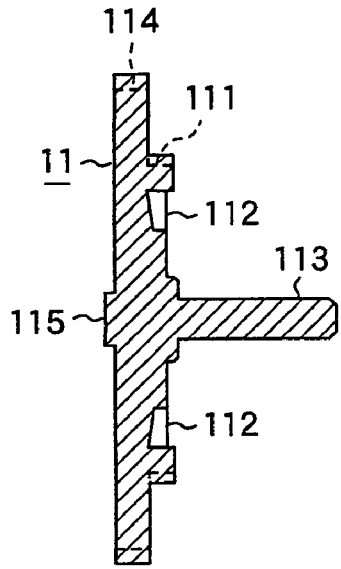
FIG. 15 is a longitudinal cross-sectional view of the rotary button of FIG. 14.
Figure 16:
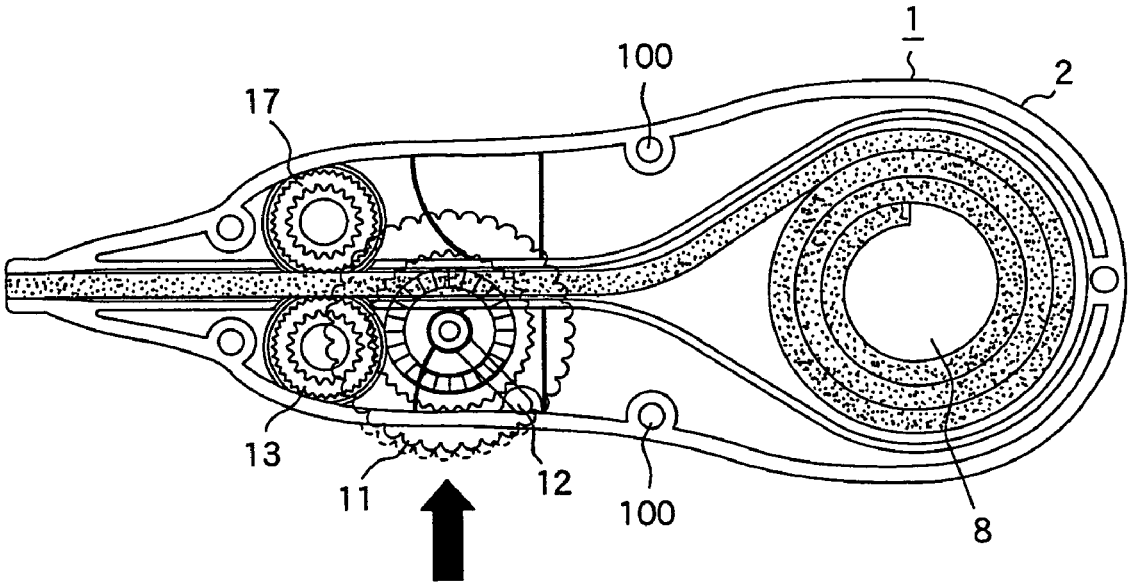
FIG. 16 is a front view for assistance in explaining a state in which an anti-reverse turn stopper of the dispenser body is released.

The cover 3 is formed with a protruding portion 10 protruding outwards. The disk-shaped rotary button 11 (external operation member) is provided for rotation in a space defined by the protruding portion 10. As shown in FIGS. 14 and 15, the rotary button 11 is formed on its outer circumference with knurls 114 for easy rotary operation. A portion of the rotary button 11 is outwards protruded from the outer circumferential wall 2 so as to make it possible to operate the rotary button 11 externally. The knurls 114 are formed to advance the eraser and prevent the same from sliding. Needless to say, the knurls 114 may be shaped in a lattice pattern or in a rimple pattern such as circle or rectangle.

Figure 3:
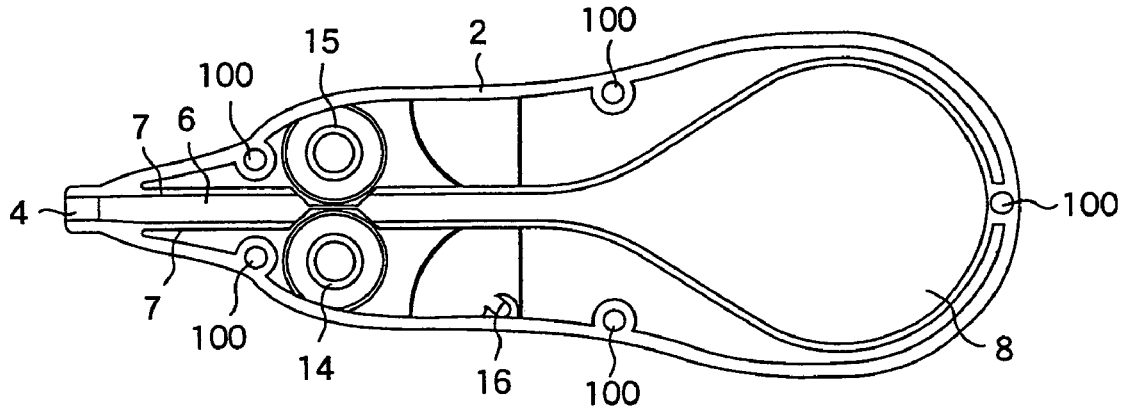
FIG. 3 is a front view of a dispenser body of the eraser dispenser shown in FIG. 1.
Figure 4:
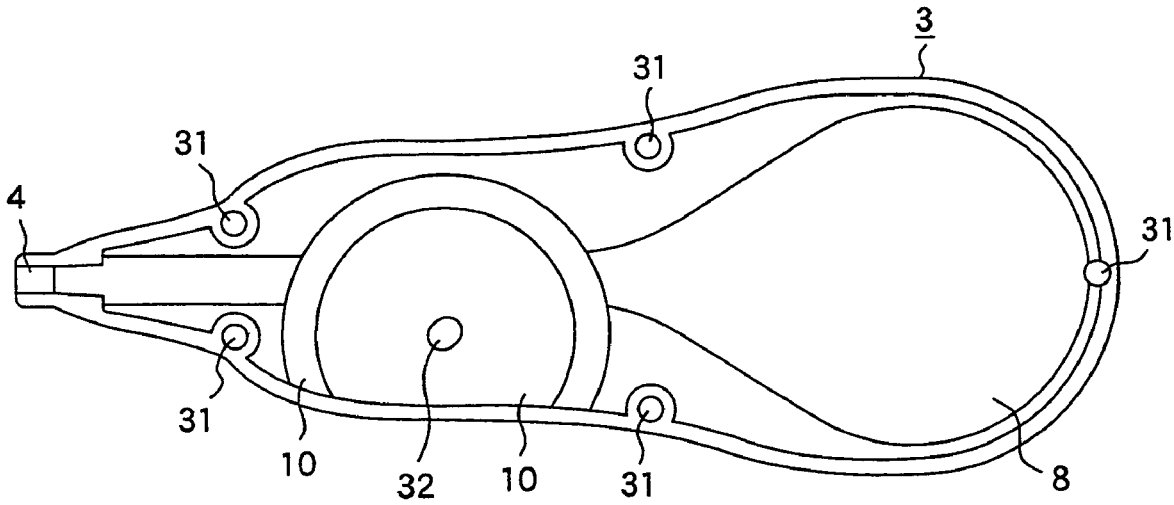
FIG. 4 is a back view of the cover shown in FIG. 1.
Figure 5:
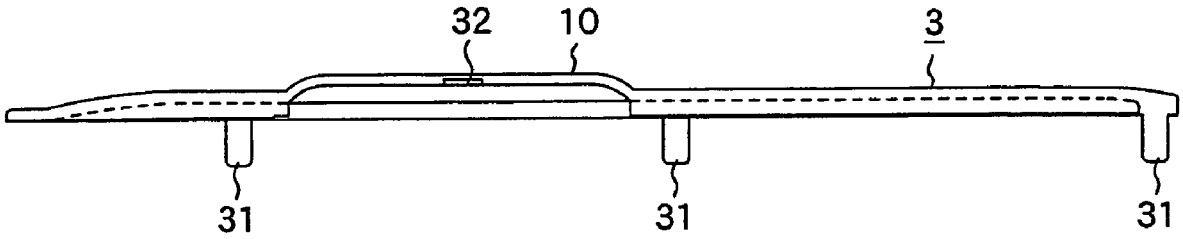
FIG. 5 is a plan view of the cover of FIG. 4.
Figure 6:
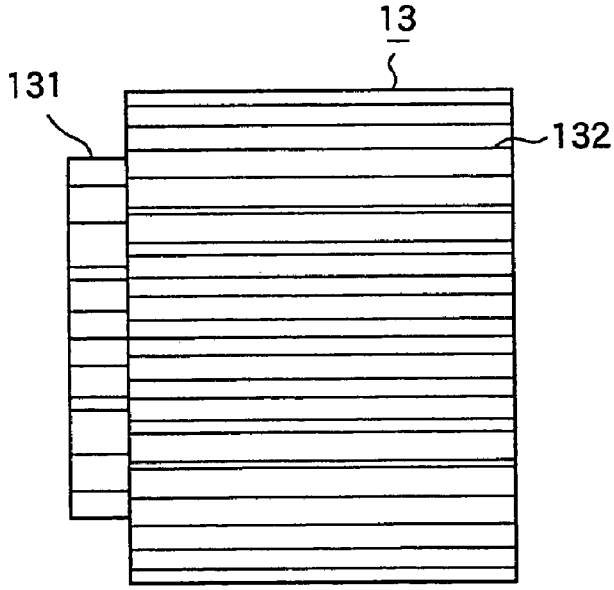
FIG. 6 is a plan view of a driving roller shown in FIG. 1.
Figure 7:
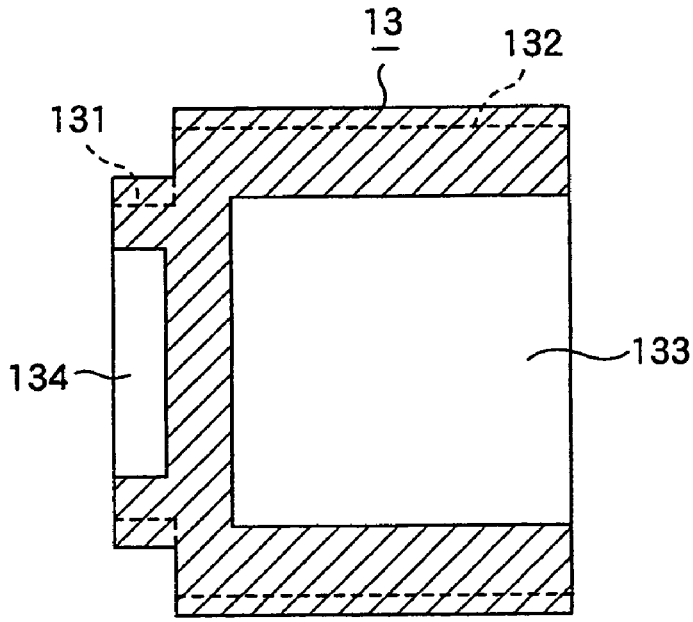
FIG. 7 is a longitudinal cross-sectional view of the driving roller of FIG. 6.
Figure 8:
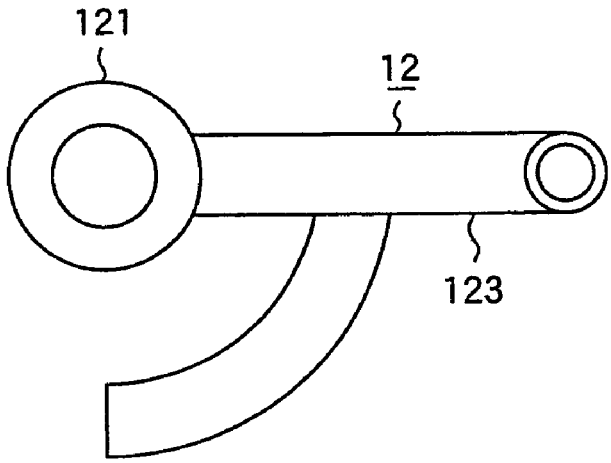
FIG. 8 is a front view of an arm shown in FIG. 1.
Figure 9:
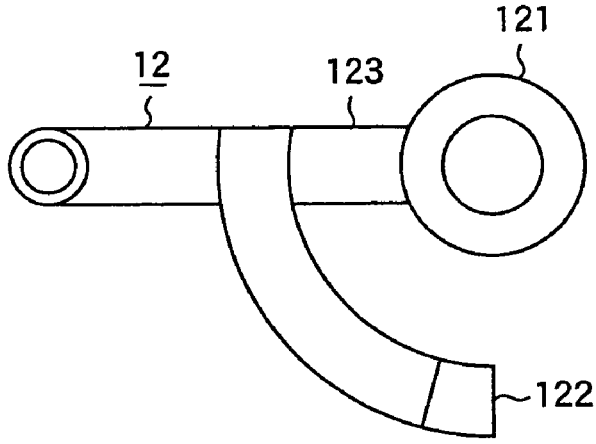
FIG. 9 is a back view of the arm of FIG. 8.
Figure 10:
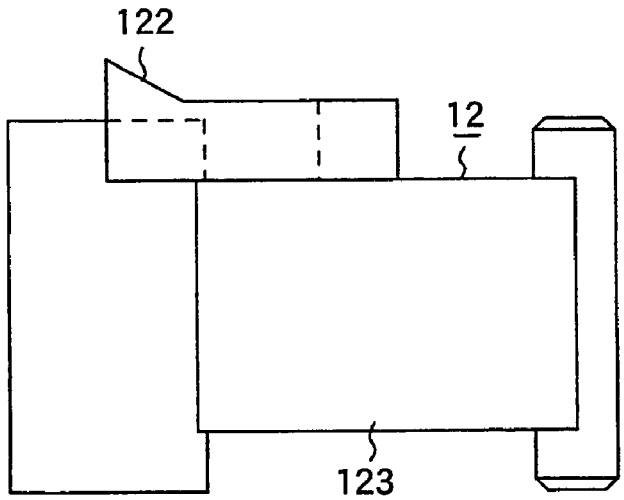
FIG. 10 is a plan view of the arm of FIG. 8.
Figure 11:
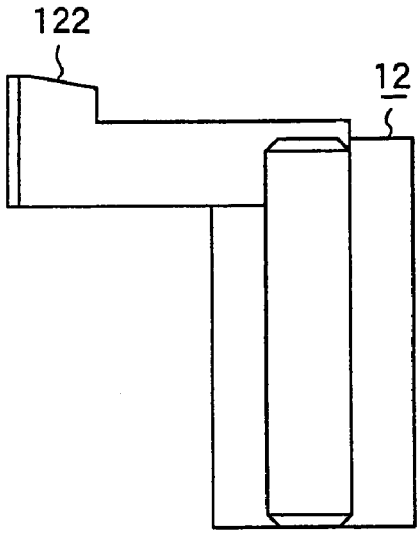
FIG. 11 is a right side view of the arm of FIG. 8.
Figure 12:
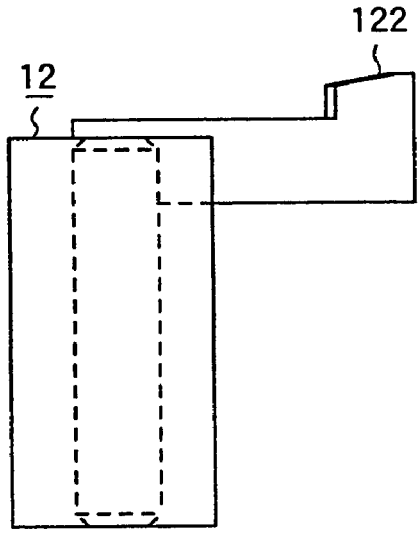
FIG. 12 is a left side view of the arm of FIG. 8.
Figure 13:
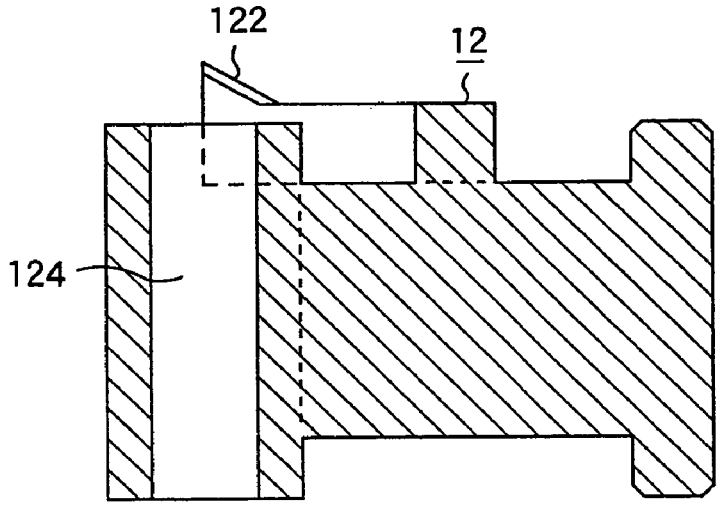
FIG. 13 is a longitudinal cross-sectional view of the arm of FIG. 8.

A small gear part 20 is disposed coaxially and integrally with the rotary button 11. The rotary button 11 is formed in its side surface with a gear portion 112 (anti-reverse turning means), with which a detent 122 of an anti-reverse turning arm 12 is engaged. The anti-reverse turning arm 12 is to be described later. Preferably, part of the gear portion 112 adapted to prevent turning is formed to be inclined at an angle of, e.g., about 30 degrees. An attachment shaft 113 of the arm 12 is projected from the center of the rotary button 11. Referring to FIG. 3, reference numerals 14 and 15 denote roller mounting portions for a driving roller 13 and a driven roller 17, respectively. In addition, reference numeral 16 denotes a claw-like retainer, which is formed on the dispenser body 1 to retain the arm 12.

FIGS. 8 to 13 illustrate the anti-reverse turning arm 12 in which its proximal pivotal part 121 is coupled to the detent 122 by way of a flexible part 123. When the rotary button 11 is pushed inwards, the flexible part 123 is bent to release engagement of the detent 122, so that the eraser can forcibly be retracted into the dispenser body 1 for storage. The detent 122 can be engaged with the gear portion 112 for anti-reverse turning. Incidentally, reference numeral 124 denotes a mounting hole adapted to mount the rotary button 11 to an arm-mounting portion.

The parallel guide walls 7 of the dispenser body 1 are provided with respective operation openings. The driving roller 13 having a pinion 131 is rotatably provided near one of the operation openings, that is, near a driving side operation opening. The driving roller 13 is brought into contact with a side of the eraser within the eraser passageway 6 to hold the same. The pinion 131 of the driving roller 13 is engaged with the small gear part 20 of the rotary button 11. When the rotary button 11 is turned, the pinion 131 and the small gear part 20 cooperatively turn counterclockwise to advance the eraser. In this case, if the driving roller 13 is formed on its outer circumference with knurls to provide a frictional force, the eraser can be advanced steadily. Incidentally, in FIG. 7, reference numeral 133 denotes a portion fitted to the dispenser body 1, whereas reference numeral 134 denotes a recess. However, the portion 133 and the recess 134 may be formed into a through hole.

On the other hand, a driven roller 17 (receiving member) is rotatably provided near the other of the operation openings, that is, near a driven side operation opening. The driven roller 17 is brought into contact with another side of the eraser within the eraser passageway 6 to hold the same. Incidentally, the driven roller 17 may have the same construction as that of the driving roller 13 as shown in FIGS. 14 and 15 so long as it receives a pressing force of the driving roller 13 and directs the eraser. The driven roller 17 may be stationary.

A description will be made of an anti-reverse rotation mechanism for the rotary button 11 in relation to the arm 12 shown in FIGS. 8 to 13. The detent 122 formed on the arm 12 is engaged with the gear portion for anti-reverse turning formed on the rotary button 11 to thereby prevent the rotary button 11 from turning reversely. Specifically, since the detent 122 is received by the gear portion 112 formed in the lateral side of the rotary button 11, the reverse turning can be prevented. On the other hand, the gear portion 112 is formed to be inclined in the direction of normal rotation, so that the detent 122 cannot be engaged with the gear portion 112. Thus, the rotary button 11 can be turned while the arm 12 is being bent. When the eraser extended from the distal opening 4 is retracted into the dispenser body, pressing the rotary button 11 inward bends the flexible portion 123 of the arm 12 to disengage the detent 122 from the gear portion 112, thereby releasing the engagement.

Figure 17:
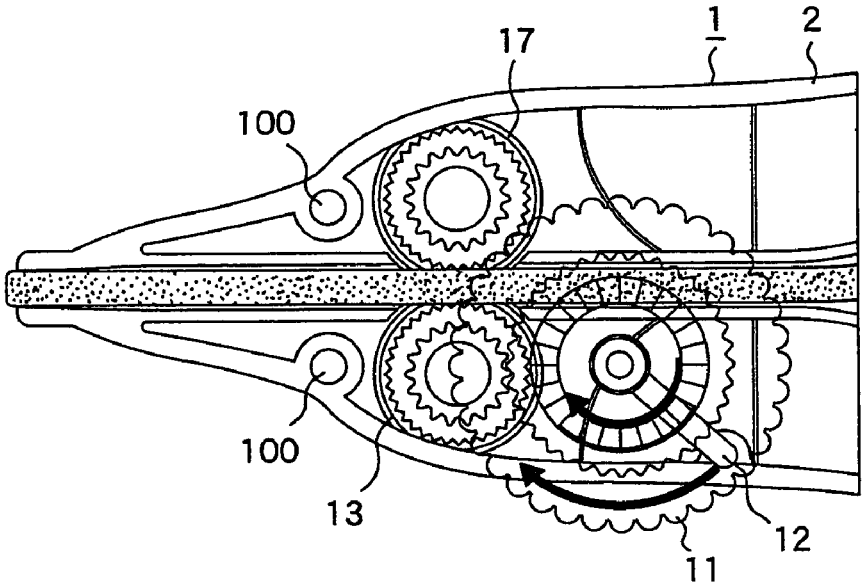
FIG. 17 is a front view for assistance in explaining a rotary dispenser mechanism.
Figure 18:
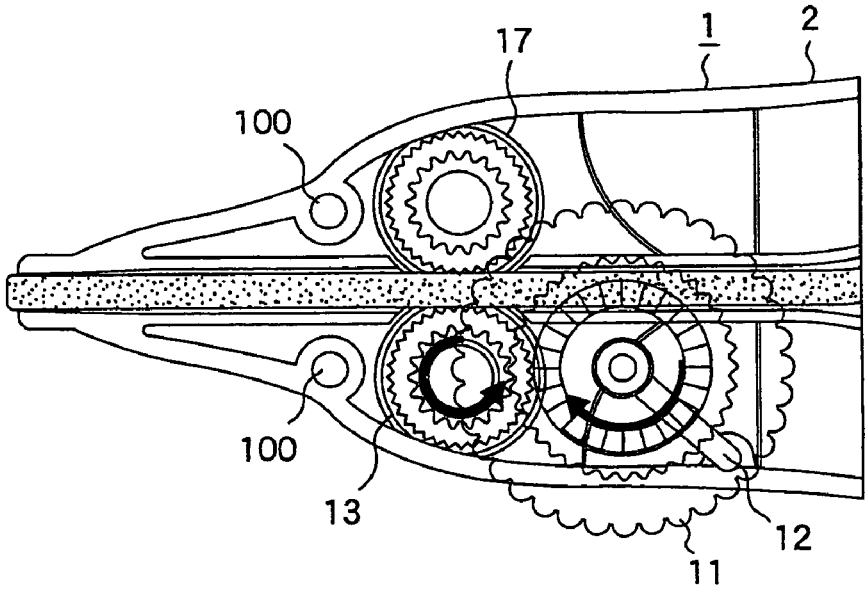
FIG. 18 is a front view for assistance in explaining a rotary dispenser mechanism.
Figure 19:
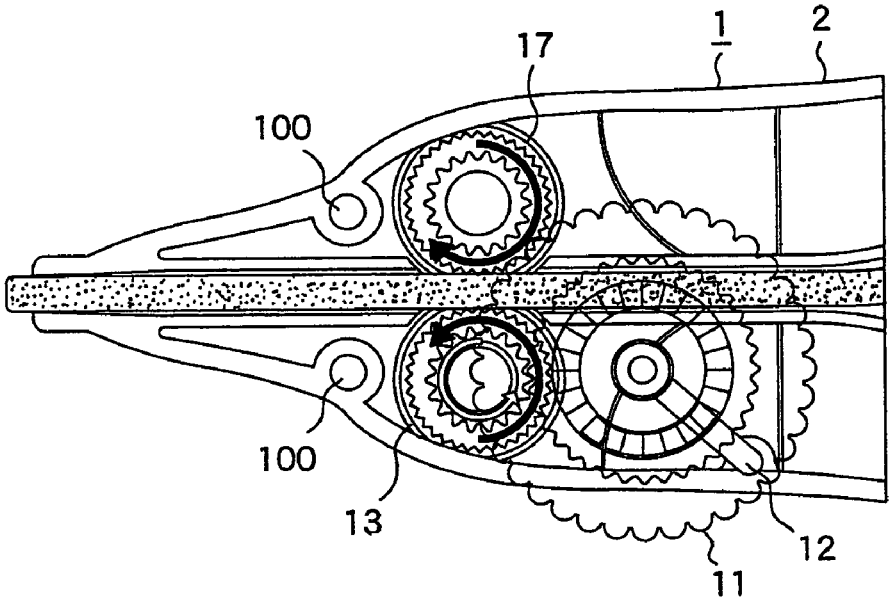
FIG. 19 is a front view for assistance in explaining a rotary dispenser mechanism.

Referring to FIGS. 17 to 19, the operation of the eraser dispenser according to the embodiment will be described below. FIGS. 17 to 19 illustrate transmission of the rotational force of the rotation-feeding mechanism, that is, advancement of the eraser. At first, extending of the eraser from the distal opening 4 of the dispenser body 1 is explained.

Turning the rotary button 11 as the larger gear clockwise makes the small gear part 20 integral with the rotary button 11 turn in the same direction as the rotary button 11 (see FIG. 17).

Then, since gear teeth formed inside the small gear part 20 is engaged with corresponding gear teeth formed on the driving roller 13 for advancing the eraser, the driving roller 13 is turned in a direction opposite to the turning direction of the rotary button 11. In other word, the driving roller 13 engaged with the small gear part 20 is forcibly turned counterclockwise (see FIG. 18). Since a portion of the driving roller 13 projecting between the guide walls 7 is in contact with a side of the eraser, the eraser can be advanced forward along the guide walls 7.

At this time, the turnable driven roller 17 faces the driving roller 13 so as to securely hold the eraser therebetween. Specifically, since a portion of the driven roller 17 projecting into the eraser passageway 6 presses the other side of the eraser, the clockwise turning of the driven roller 17 enables the eraser to securely advance in the eraser passageway 6 of the guide walls 7 and extend through the distal opening 4 (see FIG. 19).

When the eraser is retracted into the dispenser body, the engagement of the detent 122 of the anti-reverse turning arm 12 with the gear portion 112 of the rotary button 11 is released. More specifically, the rotary button 11 is pressed toward inside the dispenser body through the operation-opening formed in the outer circumferential wall 2 to bend the arm 12 supporting the rotary button 11. This disengages the gear portion 112 from the detent 122, thereby causing the driving roller 13 holding the eraser to turn freely. Consequently, the portion of the eraser extended from the distal opening 4 can be retracted in the dispenser body by pressing the eraser thereinto.

Figure 20:
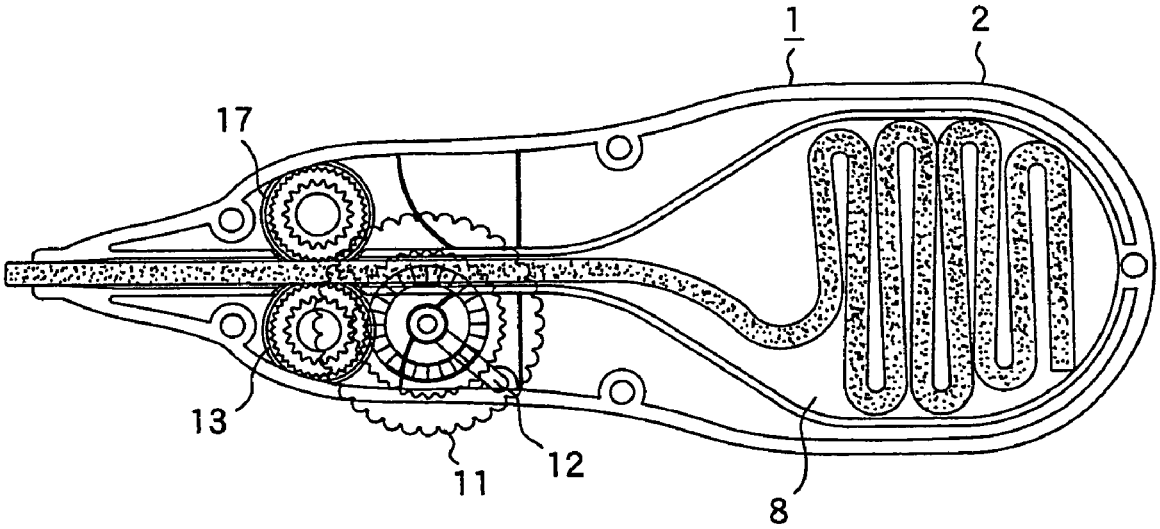
FIG. 20 is a view for illustrating a modification of the first embodiment in which the eraser is stored in an accordion-folded fashion.
Figure 21:
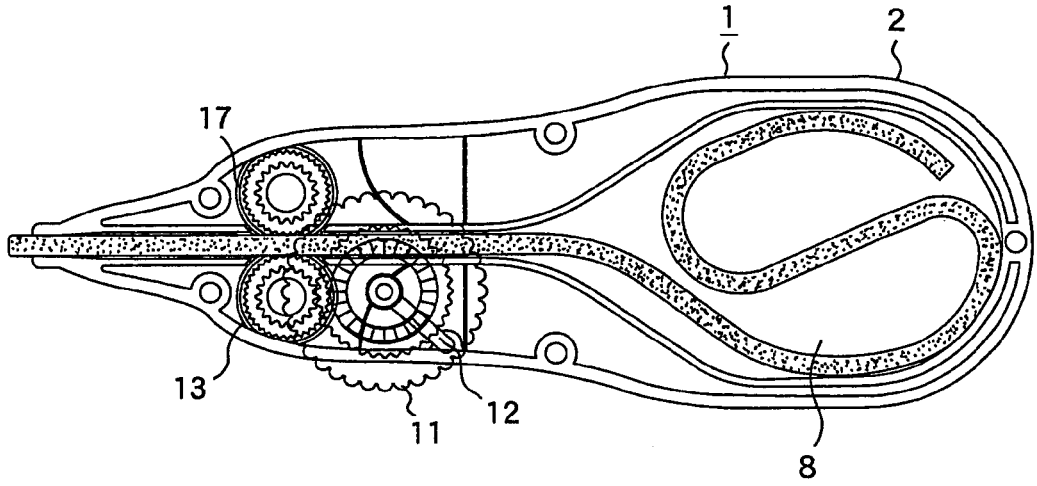
FIG. 21 is a view for illustrating another modification of the first embodiment in which the eraser is stored at random.

Incidentally, FIGS. 20 and 21 show eraser-stored states according to modifications of the first embodiment; FIG. 20 shows a state in which the rear portion of the eraser is stored in the storing chamber 8 in an accordion fashion; and FIG. 21 shows another state in which the rear portion of the eraser is stored in a random fashion.

Embodiment 2

Figure 22:
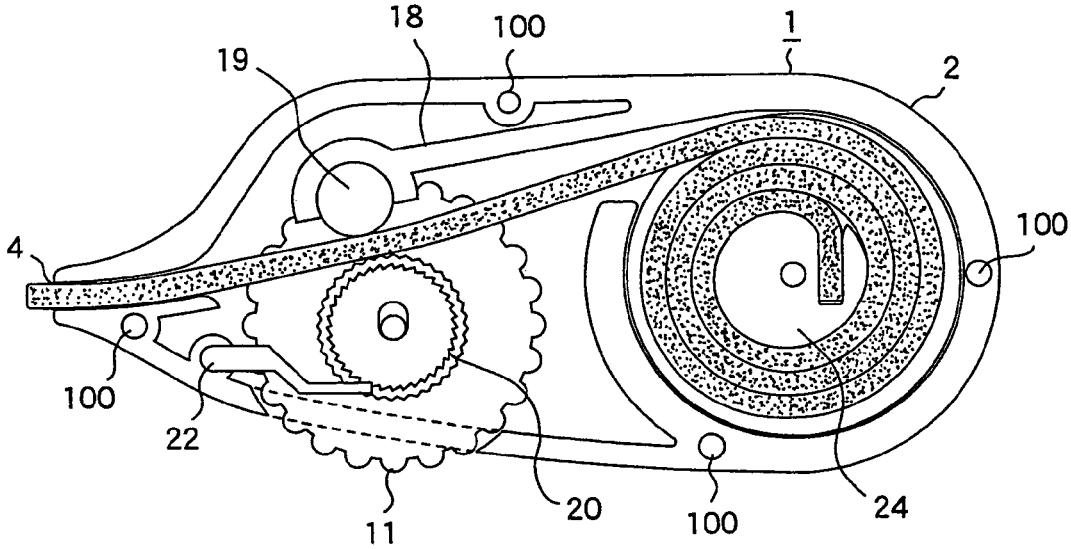
FIG. 22 is a front view of a dispenser body according to a second embodiment of the present invention with its cover removed.
Figure 23:
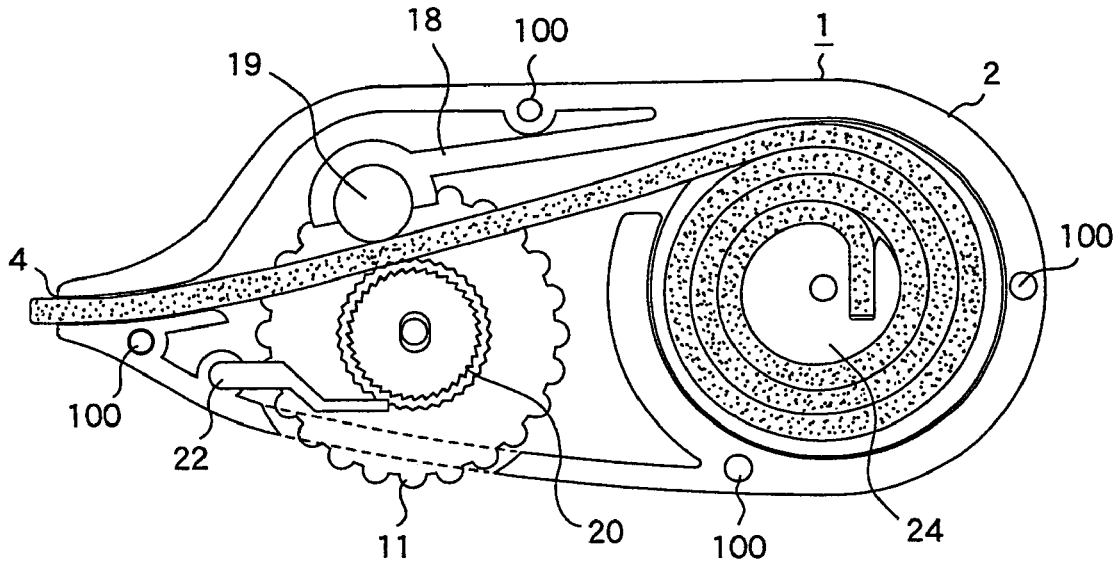
FIG. 23 is a view of the dispenser body of FIG. 22 with an anti-reverse turn stopper released.

FIGS. 22 and 23 show an eraser dispenser according to a second embodiment. In this embodiment, the teeth of a small gear part 20 formed integrally and coaxially with a rotary button 11 are in direct contact with a side of the eraser. The rotary button 11 advances the eraser in cooperation with a receiver arm 18 extending from an outer circumferential wall 2 of a dispenser body, and a rolling element 19. A stopper bar 22 extending from the front of the dispenser body toward the rear is engaged with the small gear part 20 of the rotary button 11. As shown in FIG. 23, the rotary button 11 is pressed innermostly and displaced inward, which releases the engagement of the stopper bar 22 with a gear portion 112, whereby the rotary button 11 can be turned reversely. Thus, the eraser can be retracted.

In this embodiment, the eraser is wound about a core 24 in a storing chamber 8 of the dispenser body 1. This embodiment does not include the driving roller 13 as shown in the first embodiment. Instead, the small gear part 20 of the rotary button 11 serves as an eraser advance means, which is in direct contact with the eraser so as to advance it. The receiving arm 18 is extended forward from the outer circumferential wall 2 and is urged inward. The receiving arm 18 is provided at its distal end with the rolling element 19 as a receiving member, which faces the small gear part 20.

The stopper bar 22 is extended rearward from the outer circumferential wall. The distal end of the stopper bar 22 is engaged with the small gear part 20 of the rotary button 11 50 as to prevent the rotary button 11 from turning reversely (see FIG. 22). When the rotary button 11 is pressed inward against the urging force of the arm 18, the shaft of the rotary button 11 is displaced inward in an oval bearing hole 32. Consequently, the stopper bar 22 is disengaged from the small gear part 20, which makes it possible to turn the rotary button 11 reversely. Thus, the eraser can be retracted in the dispenser body with ease while the rotary button is idled.

Embodiment 3

Figure 24:
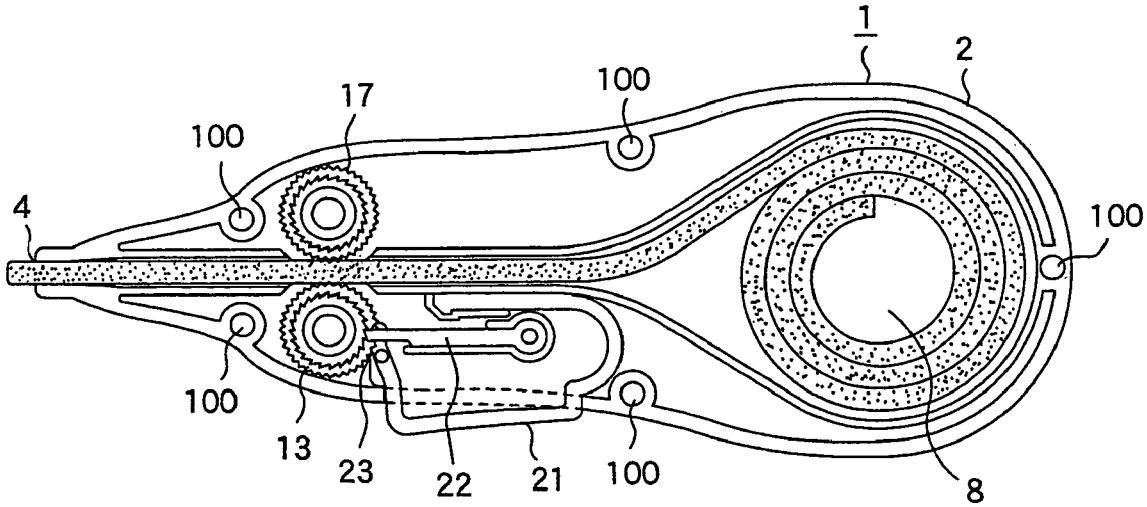
FIG. 24 is a front view of a side-knock type dispenser body of a third embodiment with its cover removed.
Figure 25:
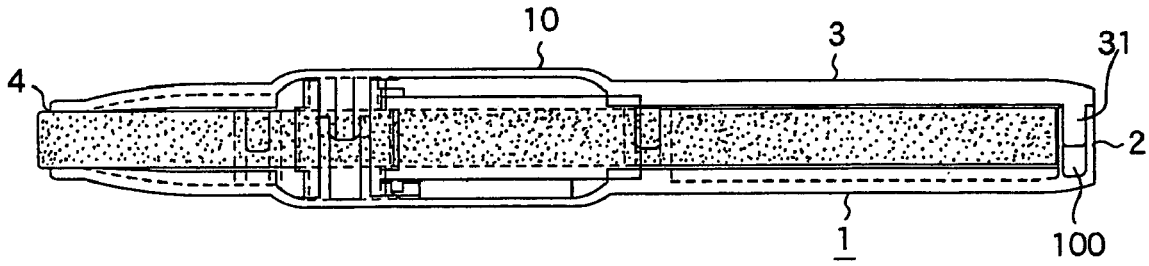
FIG. 25 is a plan view of the dispenser body of FIG. 24.
Figure 26:
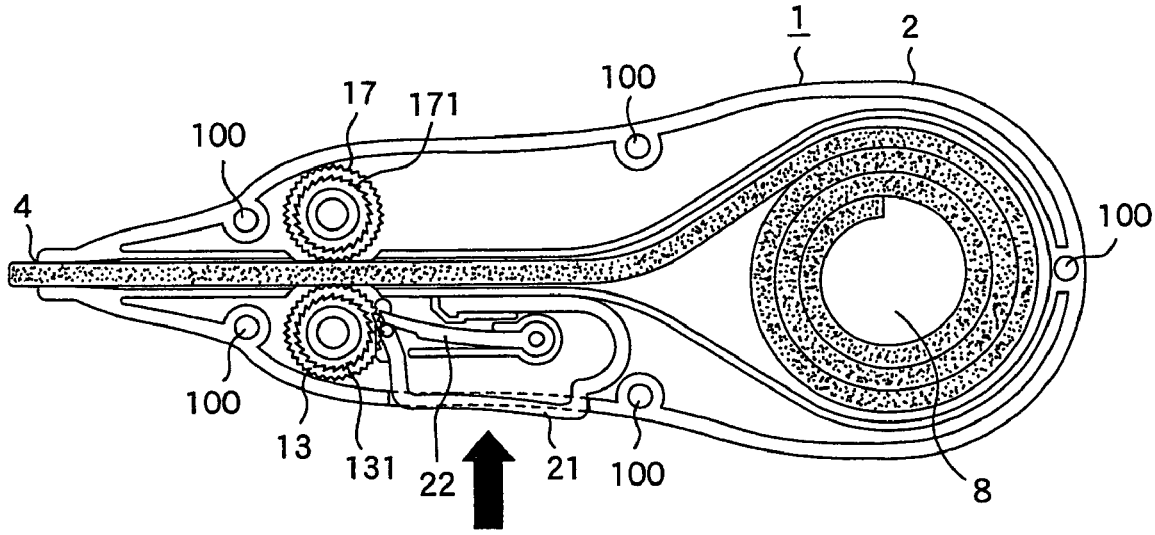
FIG. 26 is a view of the dispenser body of FIG. 24 with the anti-reverse turn stopper released.

FIGS. 24 to 26 show a side knock operation type eraser dispenser according to a third embodiment of the invention. This eraser dispenser does not include the core 24 for the eraser as shown in the second embodiment. The eraser of this embodiment is stored in a spiral manner as with the first embodiment. In this embodiment, a side knock button 21 has such high resiliency as to be flexible. Reference numeral 23 in the figures denotes a projection adapted to push the stopper bar 22.

FIG. 25 is an assemble view of the side knock type eraser dispenser, in which the side knock button 21 is being pressed. The side knock button 21 is formed its distal end with a saw-tooth-like portion. When this saw-tooth-like portion pushes a corresponding saw-tooth-like portion formed in a small gear portion 131 of a driving roller 13, the driving roller 13 is turned. Further pushing the corresponding saw-tooth-like portion causes the saw-tooth-like portion of the side knock button 21 to disengage from the corresponding saw-tooth-like portion, so that the driving roller 13 can be made reversely turnable by pushing an anti-reverse turn bar.

More specifically, the side knock button 21 is disposed in the operation opening of the outer circumferential wall 2 in such a manner as to be pressable inward. The distal end of the knock button 21 is engaged with the small gear portion of the driving roller 13. The knock button 21 is depressed by the knocking operation to thereby turn the small gear portion counterclockwise. That is, the driving roller 13 is turned counterclockwise, which advances the eraser. A driven roller 17 is disposed to face the driving roller 13 with the eraser held therebetween. The driving roller 13 and the driven roller 17 cooperate to advance the eraser. Thus, pressing the knock button 21 can advance the eraser.

The eraser can be used to erase characters, etc. written on a paper surface by pressing it against the paper surface. The driving roller 13 is prevented from being reversely turned by anti-reverse turn stopper; therefore, the eraser is not been retracted into the dispenser body during the use of it, that is, it does not become unserviceable. On the other hand, when the eraser is retracted, the knock button 21 is pressed innermostly to disengage the anti-reverse turn stopper from the driving roller 13. Thus, the eraser can be pressed into the dispenser body with ease.

Embodiment 4

Figure 27:
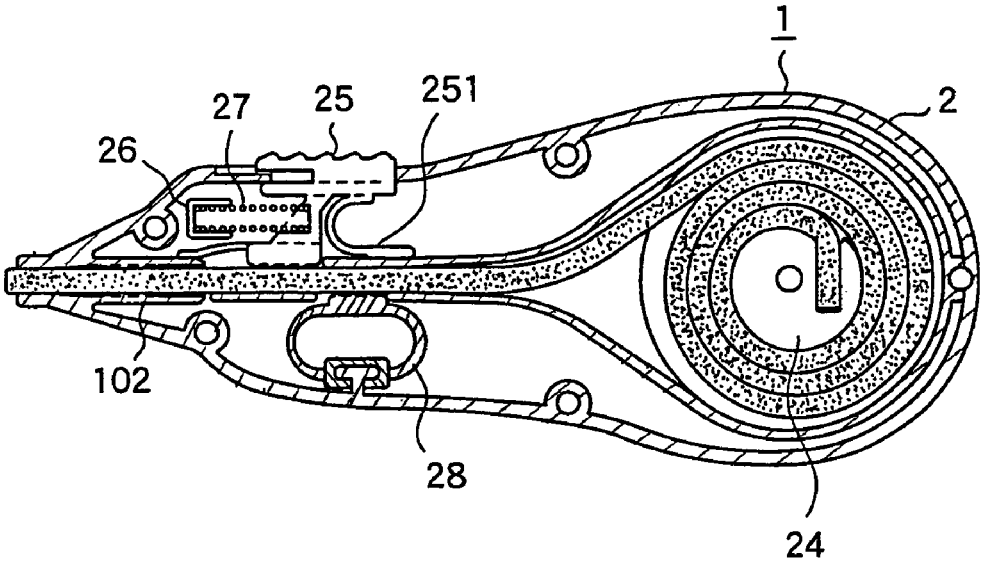
FIG. 27 is a cross-sectional view of a slide operation type dispenser body according to a fourth embodiment.
Figure 28:
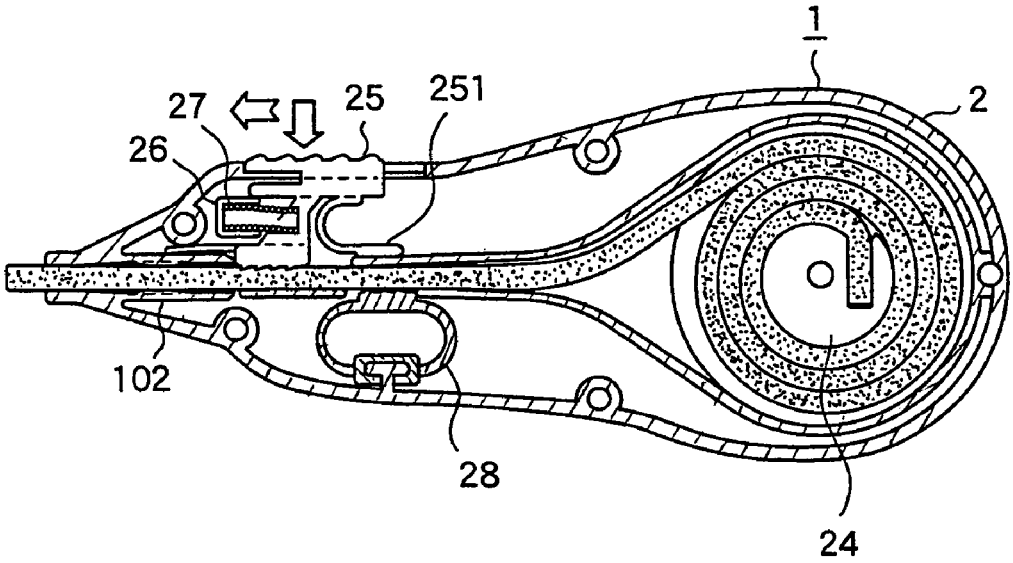
FIG. 28 is a view of the dispenser body of FIG. 27 in which the eraser is unwound to advance.

FIGS. 27 and 28 show a slide operation type eraser dispenser according to a fourth embodiment of the present invention. A sliding button 25 is disposed in an opening of an outer circumferential wall 2 of the dispenser body 1. This sliding button 25 has a resilient leg 251, which constantly urges the sliding button 25 toward the outside of the dispenser body. In addition, the sliding button 25 is provided at its front portion with a spring receiver 26 with a spring 27 disposed therebetween. The sliding button 25 is constantly urged backward by the spring 27.

In addition, a receiving member 28 is provided opposite to the sliding button 25 with the eraser held therebetween. The receiving member 28 has a resilient portion that is in contact with the eraser, in order to prevent the eraser from retracting. Further, the resilient portion is formed like saw-teeth not only to facilitate advancement of the eraser but also to prevent the eraser from moving backward. In the figures, reference numeral 102 denotes an eraser fitting rib or a guide means formed near the distal opening.

FIG. 28 illustrates a state in which the slide button 25 is depressed inward and slid forward to advance the eraser wound around a core 24. In this case, the saw-teeth-like portion, of the sliding button 25, in contact with the eraser is formed such that it facilitates the advancement of the eraser due to more frictional contact when the eraser is advanced whereas it facilitates the slide of the eraser due to less frictional contact when the eraser is retracted.

Embodiment 5

Figure 29:
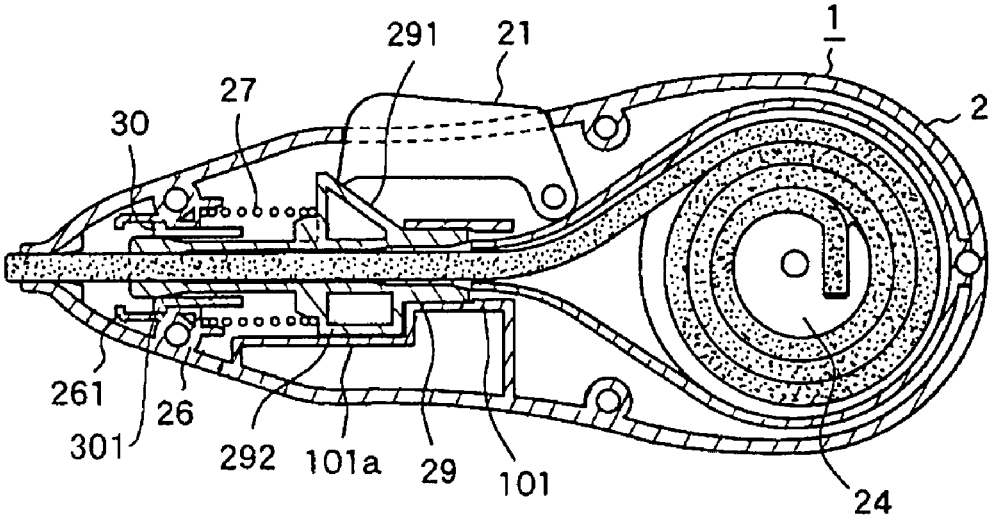
FIG. 29 is a cross-sectional view of a chuck-advance type dispenser body.
Figure 30:
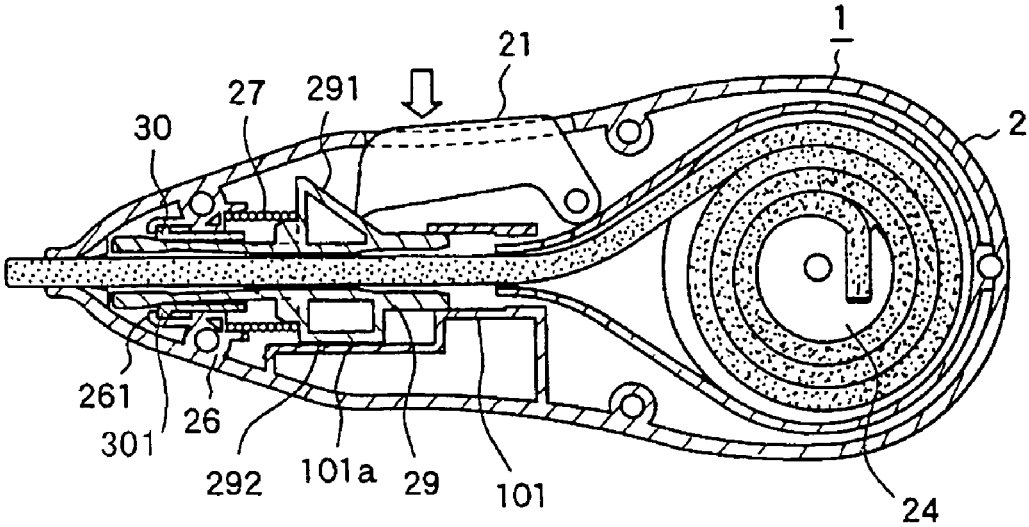
FIG. 30 is a view of the dispenser body of FIG. 29 with its eraser unwound to advance.

FIGS. 29 and 30 depict a chuck advance type eraser dispenser according to a fifth embodiment of the present invention. By operating a knock button 21, an eraser is advanced by use of a chuck mechanism as an eraser advance means. The eraser is longer than the overall length of a dispenser body and is wound around a core 24. FIG. 29 illustrates a state in which a holding chuck 29 is closed to hold the eraser. The knock button 21 is disposed for pivotal movement in an opening of the outer circumferential wall 2 of the dispenser body 1. A front corner portion of the knock button 21 is in contact with the inclined part 291 of a chuck 29, which is provided in the dispenser body 1 for slidable movement. Note that the inclined face of the inclined part 291 is formed to descend backward. In addition, the inclined part 291 may be formed differently from the chuck 29.

The chuck 29 is formed with a flat receiving part 292, which faces the inclined part 291 with the eraser interposed therebetween. A supporting portion 101 is coupled to the outer circumferential wall 2 to hold the proximal part of the chuck 29. The flat receiving part 292 is guided along the guide surface 101*a* of the supporting portion 101, so that the chuck 29 can slide smoothly.

A spring 27 is disposed between the front upright wall of the slope part 291 and a receiving member 26 so as to constantly urge the chuck 29 backward. A chuck ring 30 is loosely fitted to a distal end of the chuck ring 30. The chuck ring 30 is formed at its front edge with a flange 301. This flange 301 is normally engaged with a step formed on the inner circumference of the spring receiver 26 by the elastic force of the spring 27. A spring receiver 26 is formed at its front edge with an inner flange 261, which serves as a stopper for the flange 301 of the chuck ring 30.

FIG. 30 depicts a state in which the knock button 21 is depressed to extend the eraser from the distal opening 4. As shown in the figure, the knock button 21 is depressed to thereby allow the front corner portion thereof to descend along the inclined face of the inclined part 291, which advances the chuck 29 together with the eraser against the backward elastic force of the spring 27. In the course of the advance of the chuck 29, also the chuck ring 30 is advanced together with the eraser; however, the flange 301 of the chuck ring 30 comes into contact with the inner flange 261 of the spring receiver 26 for engagement. As a result, the chuck ring 30 disengages from the chuck 29, whereby the chuck 29 is opened so as not to hold the eraser. Thereafter, pressing the knock button is released to move the chuck 29 to its initial position where the chuck 29 holds the eraser. In this state, the eraser can be used because it is held by the chuck 29 so as not to retract into the dispenser body.

Embodiment 6

Figure 31:
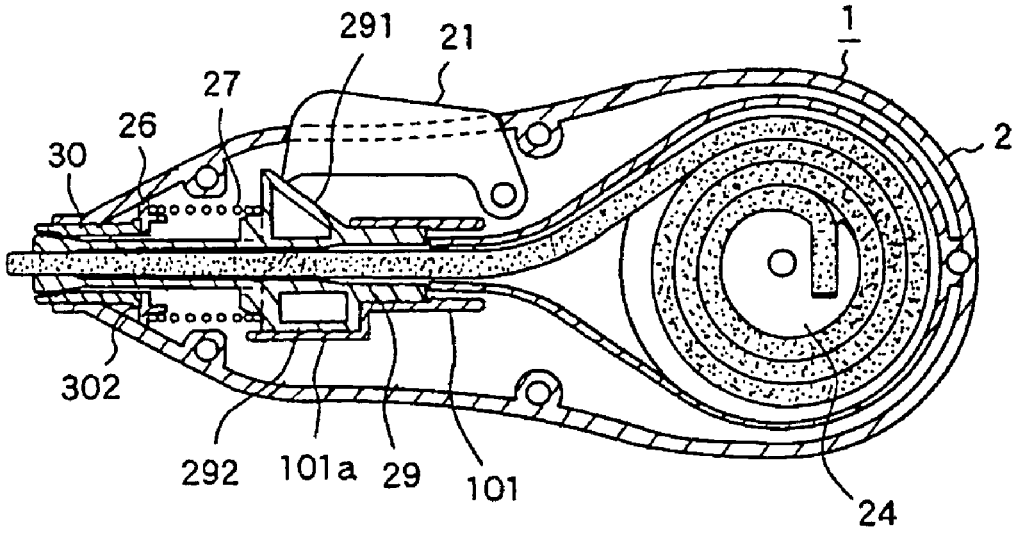
FIG. 31 is a cross-sectional view of a chuck-advance type dispenser body according to a sixth embodiment.
Figure 32:
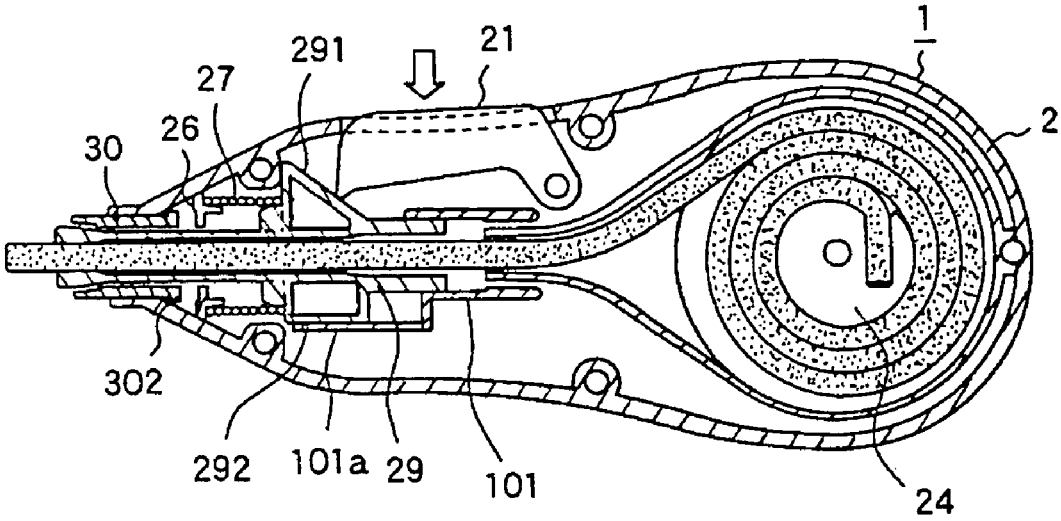
FIG. 32 is a diagram of the dispenser body of FIG. 31 with its eraser unwound to advance.

FIGS. 31 and 32 depict a chuck type eraser dispenser according to a sixth embodiment of the present invention. In this embodiment, an edge of the distal opening 4 of a dispenser body 1 is used as a part for engaging with a chuck ring 30 to open and close a chuck 29. A spring 27 urging the chuck 29 backward is disposed between a spring receiver 26 formed on the outer circumferential wall 2 of the dispenser body 1 and a front upright wall of an inclined part 291 of the chuck 29. A rear end flange 302 of the chuck ring 30 is engaged with the front of a spring receiver 26 to close the chuck 29.

FIG. 32 illustrates a state in which a knock button 21 is depressed to advance an eraser. While the chuck 29 is moved forward, the rear end flange 302 of the chuck ring 30 is engaged with the inner surface of the distal opening 4 so as to open the chuck 29.

Embodiment 7

Figure 33:
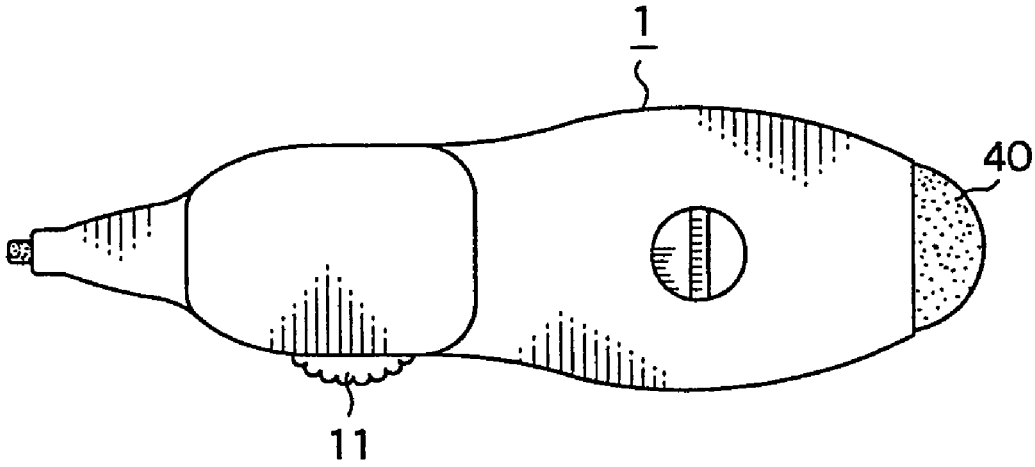
FIG. 33 is a front view of the eraser dispenser according to a seventh embodiment of this invention.
Figure 34:
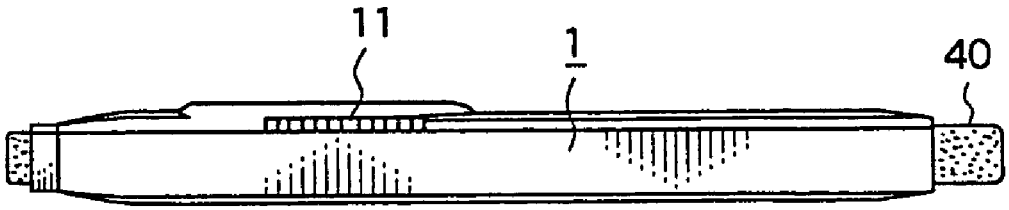
FIG. 34 is a bottom view of the eraser dispenser of FIG. 33.

FIGS. 33 and 34 show a seventh embodiment of this invention, in which there is provided at the rear portion of the dispenser a block shaped rubber eraser 40 for erasing large letters in addition to the eraser provided at the front portion thereof for erasing small letters.

While the above embodiments of the invention describe the eraser dispenser, they are applicable to other dispensers for advancing a flexible elongate object such as a plastic pencil. An anti-reverse turn mechanism serving as a retracting-prevention means which functions to prevent the eraser from retracting during the use of it may be configured to release its function with an operation member depressed, or not depressed in a normal state. In the latter case, it is to be noted that if the eraser is used, the anti-reverse turn mechanism is used with the operation member depressed.

Further, the eraser dispenser of the present invention may be a disposable single piece or may have a removable cover. In addition, the eraser dispenser may be formed to have a storing chamber of the dispenser body as an independent one. More specifically, the eraser dispenser may have a combination of an eraser storing unit and a main unit incorporating the advancing mechanism. In this case, the eraser can be replaced with a new one by a single operation.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An eraser dispenser comprising:

a dispenser body formed with a storing chamber capable of storing therein an eraser that is longer than an overall length of the dispenser body;

an external knock-operation member which is disposed in the dispenser body and is operated externally; and eraser-advancing means for extending the eraser from a distal opening of the dispenser body by operating the external operating member, wherein the eraser-advancing means includes:

a chuck operative to hold the eraser;

a chuck ring which is loosely fitted to the chuck; and a chuck spring which urges the chuck backward.

2. The eraser dispenser according to claim 1, wherein in the course of advancement of the chuck, the chuck ring comes into contact with an opening end of the dispenser body so as to open the chuck.

3. The eraser dispenser according to claim 1, wherein the dispenser body is enclosed by an outer circumferential wall having a distal opening and is covered with a cover.

4. The eraser dispenser according to claim 1, wherein the chuck is provided with an inclined part whose inclined face descends backward and a corner portion of the chuck is in contact with the inclined face.

5. An eraser dispenser comprising:

a dispenser body formed with a storing chamber capable of storing therein an eraser that is longer than an overall length of the dispenser body;

an external knock-operation member which is disposed in the dispenser body and is operated externally; and eraser-advancing means for extending the eraser from a distal opening of the dispenser body by operating the external operating member, wherein the eraser-advancing means is a chuck serving as eraser-backward movement prevention means, said chuck is provided with an inclined part whose inclined face descends backward and a corner portion of the chuck is in contact with the inclined face.

6. The eraser dispenser according to claim 5, wherein in the course of advancement of the chuck, the chuck ring comes into contact with an opening end of the dispenser body so as to open the chuck.

7. The eraser dispenser according to claim 5, wherein the dispenser body is enclosed by an outer circumferential wall having a distal opening and is covered with a cover.

* * * * *